United States Patent [19]

Gall

[11] 3,961,785

[45] June 8, 1976

[54] ARRANGEMENT FOR RESPECTIVELY WITHDRAWING A SINGLE FILM SHEET FROM A STACK OF DIRECTLY LOOSELY SUPERIMPOSED FILM SHEETS

[75] Inventor: Arthur Gall, Erlangen, Germany

[73] Assignee: Siemens Aktiengesellschaft, Erlangen, Germany

[22] Filed: Sept. 26, 1974

[21] Appl. No.: 509,727

[30] Foreign Application Priority Data

Sept. 29, 1973 Germany ..... 2349097

[52] U.S. Cl. ..... 271/119; 271/121; 271/126; 271/165

[51] Int. Cl.[2] ..... B65H 3/06; B65H 3/46

[58] Field of Search ..... 271/165, 166, 167, 160, 271/119, 120, 121, 124, 126, 114, 134, 138, 139, 133

[56] References Cited

UNITED STATES PATENTS

| | | | |
|---|---|---|---|
| 1,680,863 | 8/1928 | Ford | 271/120 |
| 3,290,042 | 12/1966 | Johnson et al. | 271/138 |
| 3,575,410 | 4/1971 | Suzuki | 271/114 X |

OTHER PUBLICATIONS

DeStefano, E. J.; "Card Feed Bed Plate," IBM Technical Disclosure Bulletin, vol. 6, No. 4, Sept. 1963, p. 95.

*Primary Examiner*—Evon C. Blunk
*Assistant Examiner*—Bruce H. Stoner, Jr.
*Attorney, Agent, or Firm*—Haseltine, Lake & Waters

[57] ABSTRACT

An arrangement for respectively withdrawing a single film sheet from a stack of directly loosely superimposed film sheets, particularly for use in X-ray filming apparatus, including a magazine for the film sheets, pressure plate for pressing the stack of film sheets against the floor of the magazine, a withdrawal slot in a side wall of the magazine calibrated in the plane of the extreme film sheet introduced which is located on the floor of the magazine. The arrangement includes a step roll and conveyor rolls for the conveyance of the particular extreme film sheet positioned on the floor of the magazine through the withdrawal slot. The floor of the magazine concurrently forms the boundary edge of the calibrated withdrawal slot, while in the region of the edge of the extreme film sheet located on the floor which is remote from the withdrawal slot, the floor of the magazine has inserted a step roll having its axis extending in parallel to this edge.

10 Claims, 3 Drawing Figures

ARRANGEMENT FOR RESPECTIVELY WITHDRAWING A SINGLE FILM SHEET FROM A STACK OF DIRECTLY LOOSELY SUPERIMPOSED FILM SHEETS

FIELD OF THE INVENTION

The present invention relates to an arrangement for respectively withdrawing a single film sheet from a stack of directly loosely superimposed film sheets, particularly for use in X-ray filming apparatus, including a magazine for the film sheets, pressure means for pressing the stack of film sheets against the floor of the magazine, a withdrawal slot in a side wall of the magazine calibrated in the plane of the extreme film sheet introduced which is located on the floor of the magazine, and including transport means for the conveyance of the particular extreme film sheet positioned on the floor of the magazine through the withdrawal slot.

DISCUSSION OF THE PRIOR ART

An arrangement on a supply magazine for sheet film employed in X-ray filming installations is known, wherein individual film sheets are lifted from a stack of loosely superimposed film sheets in the supply magazine through the intermediary of a to-and-fro moved suction device, and then conveyed through a calibrated withdrawal slot. This prior art arrangement, which requires a separate vacuum generator, a device for the control of the vacuum in the suction device, and an installation for movement of the suction device; is relatively complex. Moreover, for satisfactory and trouble-free operation, the arrangement requires a not always present freedom from dust, since the retentive force of the suction device to a considerable extent depends upon complete positioning thereof on the film sheet, and may be appreciably influenced by the presence of a thin layer of dust.

It has also been previously proposed to employ in an X-ray filming installation, which includes a supply magazine for receiving a stack of superpositioned loose film sheets, an engaging finger, which engages the particular extreme film sheet along an edge thereof, and removes the sheet by edging it from the stack. This X-ray filming installation, however, does not fully exclude the occasional withdrawal of two superimposed sheets which adhere to each other.

SUMMARY OF THE INVENTION

Accordingly, it is an object of the present invention to provide an arrangement for the withdrawal of, respectively, a single film sheet from a stack of directly superimposed film sheets, which is rugged in construction, may be equally satisfactorily employed for all current film formats, and which allows the highest possible frequency or rate of film sheet withdrawals. In an installation of the above-mentioned type, the floor of the magazine concurrently inventively forms the boundary edge of the calibrated withdrawal slot, while in the region of the edge of the extreme film sheet located on the floor which is remote from the withdrawal slot, the floor of the magazine has inserted a step roll having its axis extending in parallel to this edge. Through this construction all oscillating components are eliminated, so as to avoid vibrations even at a high film sheet withdrawing frequencies. In view of the foregoing, through the projecting edges of step rolls relatively large forces can be transmitted to a film sheet which, as a rule, are sufficient to overcome the frictional forces present between the film sheets. Finally, the calibrated withdrawal slot forms an abutment for the second film sheet measured with respect to the step of a step wheel.

The separation between two superimposed film sheets adhering to each other is rendered easier when, in a particularly advantageous further embodiment of the invention, the floor of the magazine is set back by a few film thicknesses opposite to the withdrawing direction of the extreme film sheet in the region of the withdrawal slot. Hereby, any restriction of the calibrated withdrawal slot due to entering dust is assuredly precluded. Additionally, in the instances wherein a second film sheet adheres to the outermost film sheet which is to be withdrawn, due to the bucking of the second film sheet against the upper edge of the calibrated withdrawal slot, the two mutually adherent film sheets are insignificantly bent in view of the lack of stopping capability in the region of the set back floor at the withdrawal slot, so as to facilitate detachment of the extreme film sheet positioned on the floor from the second thereto adhering film sheet.

On the basis of investigations it has been determined as particularly advantageous, when the calibrated withdrawal slot in the embodiment of the invention is approximately 1.5 film thickness wide measured perpendicular to the plane of the floor of the magazine. Although all widths of the withdrawal slot between one and two film thicknesses are possible, an optimum value is achieved at approximately 1.5 film thicknesses in which a second film sheet adhering to the outermost or extreme film sheet is held back with sufficient assurance and whereby, nevertheless, no scratching of the film surfaces occur at the withdrawal slot.

Upon withdrawal of the extreme film sheet, the frictional resistances may be reduced when, in a further embodiment of the invention, in lieu of the boundary edge of the floor of the magazine associated with the withdrawal slot, there is employed a roll. A reduction in the friction signifies lower forces which are to be transmitted through the step roll, and finally thereby higher rates or frequencies of film sheet withdrawal.

In a suitable construction of the invention, the floor of the magazine may be scalloped out with the exception of small film sheet support surfaces extending in the withdrawing direction towards the withdrawal slot. Hereby, in employing a single film width of the frictional surfaces may be completely restricted to the edge regions of the film sheet which later on are not located in the film exposure zone.

BRIEF DESCRIPTION OF THE DRAWINGS

Further details of the invention may now be ascertained in connection with the three following exemplary embodiments thereof, taken in conjunction with the accompanying drawings; in which.

DETAILED DESCRIPTION

Figure 1:
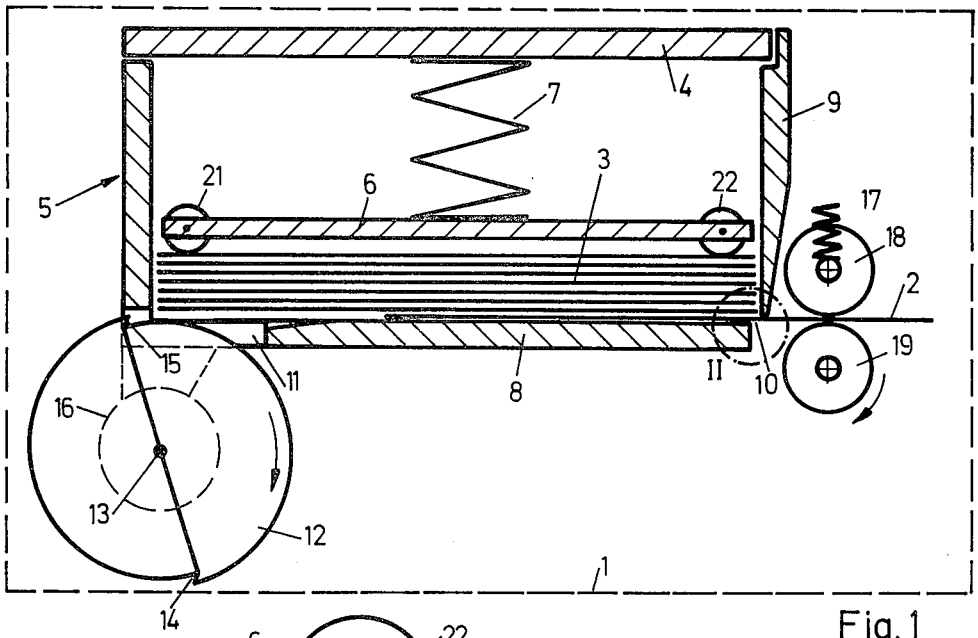
FIG. 1 shows a sectional view of an inventive arrangement for the withdrawal of respectively a single film sheet from a stack of directly loosely superimposed film sheets.

Referring now in detail to the drawing, and particularly in the sectional representation of FIG. 1, there may be ascertained in an arrangement 1 for withdrawing single film sheets 2 from a stack of superimposed film sheets, a magazine 5, which is closed by a cover 4, for receiving the stack of film sheets. The film sheets in the magazine are pressed against the floor 8 of the magazine through a pressure plate 6 which is supported against the cover 4 of the magazine by the action of a compression spring 7. Immediately above the floor of the magazine, a withdrawal slot 10 is provided in a side wall 9 of the magazine 5. The floor 8 of the magazine 5 is provided with a window 11 in the side of the magazine located opposite to the withdrawal slot 10. A step roll 12 projects into this window so as to lie against the edge of the extreme film sheet positioned directly on the floor of the magazine which is remote from the withdrawal slot 10. The step roll, with its axis 13 and its longitudinal steps 14, 15 is oriented in parallel to this edge of the film sheet. The step roll *12*, which consists of two screwed together roll halves, and which are mutually radially offset by an 0.8 film thickness, is rotated, through the intermediary of a motor drive 16, with the side facing towards the stack 3 of the film sheets, in a direction towards the withdrawal slot 10. In the withdrawing direction downstream of the withdrawal slot 10, there may be ascertained two motor driven conveyor rollers, 18, 19 which are pressed together by a spring 17, by means of which the film sheet 2, which has been conveyed through the withdrawal slot 10, is further transported.

Figure 2:
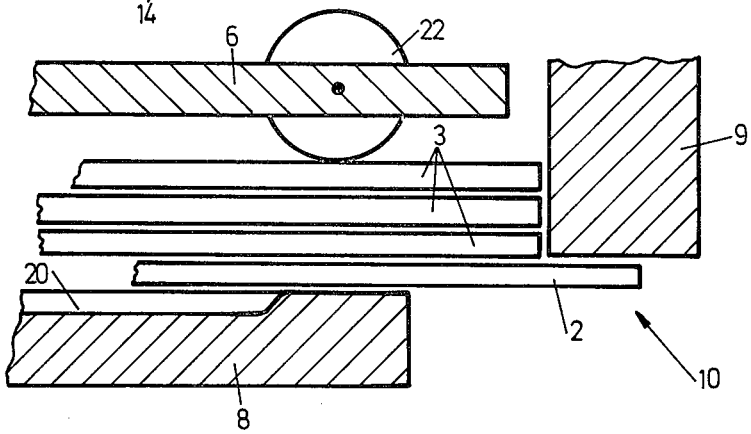
FIG. 2 is an enlarged fragmentary sectional view generally showing the encircled portion II in FIG. 1.

In the enlarged illustration of FIG. 2 the details of the calibrated withdrawal slot 10 may be more closely ascertained. Thus, through FIG. 2, it becomes apparent that the floor 8 of the magazine, which concurrently forms a boundary edge for the calibrated withdrawal slot 10, is displaced or set back in the region of the calibrated withdrawal slot displaced opposite to the direction of conveyance of the film sheets. The extent of the set back may, for example, be about 10 mm. Furthermore, it may be readily ascertained from FIG. 2 that the floor of the magazine is provided with a recess or scalloped portion 20, so that the film sheets in the embodiment of FIG. 2 have the edges thereof which extend perpendicular to the withdrawal slot 10, as well as those extending along the withdrawal slot, positioned on the floor 8 of the magazine. Additionally, the film sheets, as may be ascertained from FIG. 1, lie with their edges which are remote from the withdrawal slot in contact with the step roll 12. The pressure plate 6, by means of rolls 21, 22 (only two illustrated), rests on the stack 3 of the film sheets, and which lie on the stack precisely opposite to the support surfaces for the film sheets on the floor 8 of the magazine in, respectively, the regions of the withdrawal slot 10 and the step roll 12.

The arrangement 1 is placed into operation through actuation of the drive 16 for the step roll 12. If desired, the drive 16 may be an intermittent drive. The roll 21 of pressure plate 6, which is located opposite the step roll, presses against the lowermost film sheet 2 located on the floor of the magazine 5 against the step roll 12 projecting into the magazine through the window 11 formed in the floor of the magazine. The step roll, through the steps 14, 15 which are eccentrically offset by an approximately 0.8 film thickness, engages the edge of the particular film sheet located on the floor of the magazine which is distant from the withdrawal slot 12, and slides the sheet through the withdrawal slot 10 and between the springloaded, surface contacting driven conveyor rolls 18, 19. As soon as this film sheet 2 is engaged by the conveyor rolls, it is pulled out of the magazine 5 by the rolls. For improved detachment of the film sheet from the step of the step roll 12, the peripheral velocity of the conveyor rolls is selected so as to be somewhat higher than the peripheral velocity of the step roll. In the instances in which a second film sheet adheres to the extreme film sheet which located on the floor, upon contact by one of the steps of the step roll with the outermost or extreme film sheet due to impact of the adhering film sheet against the upper edge of the withdrawal slot 10, there is caused a buckling and reverse arching of both superimposed film sheets in the direction towards the floor 8 of the magazine. This arching or curving, which finds no resistance in proximity of the withdrawal slot due to the somewhat rearwardly displaced lower boundary edge for the withdrawal slot, leads to a curving and thereby displacement and spreading apart of both film sheets in the region of the withdrawal slot. This spreading action facilitates the separation of the two film sheets from each other. This, in particular, holds true for all instances in which the film sheets adhere to each other due to the presence of punch or stamping burns. After withdrawal of the last film sheet, the magazine may be opened in a dark-room by sliding the cover 4 back, removing the pressure plate 6 together with the compression spring 7 which is fastened to the pressure plate, and may be refilled with a new stack of unexposed film sheets. After the reinsertion of the pressure plate and the closing of the cover, wherein the compression spring is slid below the cover, the magazine is again ready for operation. By means of a closure for the withdrawal slot (not shown for purposes of clarity), premature entry of light is precluded during conveyance of the magazine.

Figure 3:
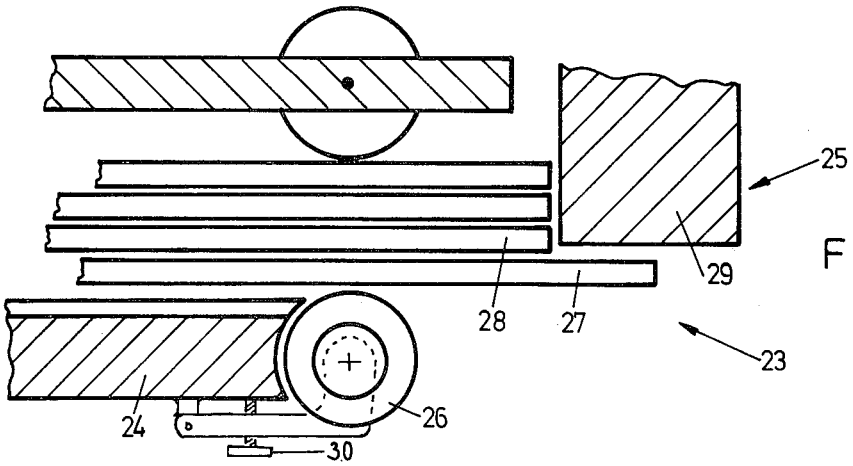
FIG. 3 is a sectional view of the enlarged portion of FIG. 2 in an arrangement wherein a boundary edge of the withdrawal slot is formed by a roll.

FIG. 3, in an enlarged scale, illustrates a modification of the arrangement 1 of FIG. 1 in the region of withdrawal slot 23, in which the leading boundary edge of the floor 24 of the magazine adjacent the withdrawal slot has a roll 26 introduced therein. This roll has the task of reducing the friction of the lowermost film sheet 27 which is to be removed with respect to the floor of the magazine 25, since for mutually adhering film sheets the increase in compressive force on these becomes considerable through the boundary edge of the withdrawal slot formed by the floor of the magazine, due to buckling of the adhering second film sheet 28 against the upper edge 29 of the calibrated withdrawal slot 23. By means of the roll 26 inserted in the floor so as to extend along the calibrated withdrawal slot, scratching of the film sheets is prevented at the calibrated withdrawal slot, as well as accomplishing a reduction in the frictional force which has to be overcome by the steps of the step roll. This finally leads to the result in that the step roll may run at a higher rotational speed, and to make possible higher frequencies of film sheet withdrawal.

It is also possible to widen the removal slot 10, 23 with the exception of both of its end regions. In this instance, the support surfaces for the film sheets, with their associated pressure means, must be located in the conveying direction directly in front of each of these end regions, in which the withdrawal slot is calibrated.

For correlation with various types of film, as well as for fine adjustment of the calibrated withdrawal slot, it may be suitable that the width of the calibrated portion of the withdrawal slot be made variable, for example, through adjusting means 30 for the supports of the roll 26 or connected to the floor 8 of the magazine.

While there has been shown what is considered to be the preferred embodiment of the invention, it will be obvious that modifications may be made which come within the scope of the disclosure of the specification.

What is claimed is:

1. In an arrangement for respectively withdrawing a single film sheet from a stack of directly loosely superimposed film sheets, particularly for use in X-ray filming apparatus, including a magazine having said stack of film disposed therein; means for pressing said stack of film sheets against the floor of said magazine; a calibrated withdrawal slot formed in a sidewall of said magazine in the plane of the extreme film sheet located on the floor of said magazine; and means for conveying the particular film sheet located on the floor of said magazine through said withdrawal slot, the improvement comprising: said magazine floor forming a boundary edge for said calibrated withdrawal slot; and a step roll projecting into said magazine through an aperture formed in the floor of said magazine in the region of an edge of said film sheet located on the floor of said magazine remote from said withdrawal slot, said step roll having the axis thereof oriented in parallel to said boundary-forming edge, said magazine floor in the region of said withdrawal slot being set back from the calibrated withdrawal slot in a direction opposite to the withdrawing direction of said extreme film sheet.

2. An arrangement as claimed in claim 1, comprising a roll in the floor of said edge forming the boundary edge of said withdrawal slot.

3. An arrangement as claimed in claim 1, comprising recesses in the floor of said magazine for reducing the surface of the floor of said magazine, said magazine being in contact with the film sheets extending in the withdrawing direction of the latter towards said withdrawing slot.

4. An arrangement as claimed in claim 3, comprising pressure means acting on said film sheet stack for biasing said film sheets towards the floor of said magazine, said pressure means being located in alignment with the surface on the floor of said magazine in contact with the lowermost film sheet of the stack of said film sheets.

5. An arrangement as claimed in claim 1, comprising adjusting means for varying the width of said calibrated withdrawal slot.

6. An arrangement as claimed in claim 1, said step roll having steps of about 0.8 film thickness in height.

7. An arrangement as claimed in claim 1, said step roll having eccentrically offset steps.

8. An arrangement as claimed in claim 1, comprising means for intermittently driving said step roll.

9. An arrangement as claimed in claim 1, said floor being set back about 10 mm., said calibrated withdrawal slot having a height of about 1.5 film thicknesses perpendicular to the plane of the floor of said magazine.

10. An arrangement as claimed in claim 9, including a roll in the floor of said edge forming the boundary edge of said withdrawal slot, said roll being in contact with the film sheets extending in the withdrawing direction of the latter towards the said withdrawal slot, said roll comprising adjusting means for varying the width of said calibrated withdrawal slot by adjusting the position of said roll relative to said withdrawal slot.

* * * * *